United States Patent [19]

Sakai et al.

[11] Patent Number: 4,937,105

[45] Date of Patent: Jun. 26, 1990

[54] HEAT-FIXING METHOD

[75] Inventors: Jun Sakai; Mitsuru Ohta, both of Nagoya, Japan

[73] Assignee: Brother Kogyo Kabushiki Kaisha, Tokyo, Japan

[21] Appl. No.: 295,834

[22] Filed: Jan. 11, 1989

[30] Foreign Application Priority Data

Jan. 19, 1988 [JP] Japan ..... 63-9338

[51] Int. Cl.[5] ..... B05D 3/12

[52] U.S. Cl. ..... 427/366; 346/1.1; 430/126

[58] Field of Search ..... 430/126; 427/366; 346/1.1

[56] References Cited

U.S. PATENT DOCUMENTS 4,510,225 4/1985 Kuehnle et al. ..... 430/126

4,568,625 2/1986 Uchiyama et al. ..... 430/120 X 4,686,163 8/1987 Ng et al. ..... 430/126 X

*Primary Examiner*—Michael Lusignan

*Attorney, Agent, or Firm*—Kane, Dalsimer, Sullivan, Kurucz, Levy, Eisele and Richard

[57] ABSTRACT

In a heat-fixing method, a sheet is prepared whose one side is coated with a release-agent layer. The sheet is superimposed upon at least a recording side of a recording medium having carried thereon an unfixed image such that the coated release-agent layer is faced to the recording side. Alternatively, the sheet is folded double into two sections such that release-agent layer sections on the respective two sections of the folded sheet are faced each other, and then the recording medium is sandwiched between the two sections of the folded sheet. The recording medium as well as the sheet is heated. Subsequently, the sheet is peeled off the recording medium.

26 Claims, 2 Drawing Sheets

HEAT-FIXING METHOD

BACKGROUND OF THE INVENTION

This invention relates to a heat-fixing method of fixing an image on a recording medium by heating, which is employed in an image recording apparatus such as, for example, a Xerographic copying machine wherein a Xerographic system is utilized to record an image onto a recording medium with a toner.

Generally, a recording medium, on which information is recorded by an image recording apparatus, has the following properties. That is, the smoother the surface condition of the recording medium after fixing, the higher the reflection optical density. Accordingly, the recording quality is good, and the fixing strength is also enhanced.

As an example of such recording medium, there is one employed in a Xerographic copying machine utilizing a Xerographic system, wherein an image is recorded on the recording medium with a toner.

The Xerographic copying machine comprises a photoconductive drum whose outer peripheral surface is formed of electrostatic material into a photoconductor. The arrangement is such that the photoconductor on the surface of the photoconductive drum is charged uniformly and is then exposed to light to form a latent image. Subsequently, toner is applied to the latent image to develop the same, i.e., to form a toner image. The toner image is then transferred to the recording medium and is fixed by a fixing unit. Thereafter, the recording medium is discharged out of the copying machine.

Various methods have been proposed as a fixing method of fixing the toner image on the recording medium to record the image onto the same. In this connection, the mainstream is a method of heating the toner image to melt the same, thereby fixing the image onto the recording medium. As a fixing system on the basis of such heating and melting, there have conventionally been known various systems including an oven system, a radiant system and the like. Generally, however, a heat-roller system has widely been used, which is high in thermal efficiency and which is capable of raising a processing speed.

The heat-roller system comprises a pair of heat roller and pressure or backup roller which are so arranged as to have their respective axes extending in parallel relation to each other in a common plane. The heat roller has a peripheral surface heated to a predetermined temperature by a heat source such as a halogen lamp or the like incorporated in the heat roller. The backup roller has an outer peripheral surface which is formed of resilient or elastic material having heat resistance. The backup roller is in pressure contact with the heat roller with a predetermined pressure. The recording medium having carried thereon an unfixed toner image is caused to pass through a nip between both the rollers. The toner image is melted by the heat from the heat roller and is fused onto the recording medium. By this melting due to heat, the toner surface is smoothed so that there is obtained a high recording quality and a high fixing strength.

Furthermore, an image recording apparatus is also known which employs a photo and pressure sensitive recording medium including a developer sheet. In this apparatus, a developer agent and a binder agent coated on the developer sheet are melted and softened to smooth the surface of the developer sheet, thereby giving a gloss to enhance the recording quality. The apparatus also utilizes a heat-roller system similar to that used in fixture of the toner mentioned above.

In the system in which the recording medium is heated by the heat roller to melt and fuse or to fix the image onto the recording medium, however, there may be a case where the toner serving as image forming material, and the developer agent and the binder agent serving as image forming material are adhered to the heat roller to cause a so-called offset phenomenon, so that the fixing cannot be made excellently and no gloss can be obtained. On the contrary, the image is disfigured. Furthermore, if the temperature of the heat roller is high excessively, for example, above 120° C., the image forming material is fused and adhere to the heat roller, making it impossible for the recording medium to pass through the nip between the rollers. On the other hand, if the temperature of the heat roller is low excessively, for example, below 120° C., the image forming material is prevented from being fused and adhering to the heat roller, but there arises such a problem that no sufficient gloss can be obtained. In this manner, it is not easy to regulate the temperature of the heat roller and the feed speed of the recording medium, making it extremely difficult to realize the excellent fixing high in recording quality.

SUMMARY OF THE INVENTION

It is therefore an object of this invention to provide an improved heat-fixing method capable of avoiding adhesion of image forming material to a high-temperature heat roller, and capable of realizing excellent fixing having a sufficient gloss, thereby enabling an image to be recorded onto a recording medium with high quality.

For the above purpose, according to the invention, there is provided a heat-fixing method comprising the steps of:

superimposing a sheet whose one side is coated with a release-agent layer, upon at least a recording side of a recording medium having carried thereon an unfixed image such that the coated release-agent layer is faced to the recording side;

heating the recording medium through the sheet by heating means; and subsequently, peeling the sheet off the recording medium.

BRIEF DESCRIPTION OF THE ACCOMPANYING DRAWINGS

DESCRIPTION OF THE EMBODIMENTS

Figure 1:
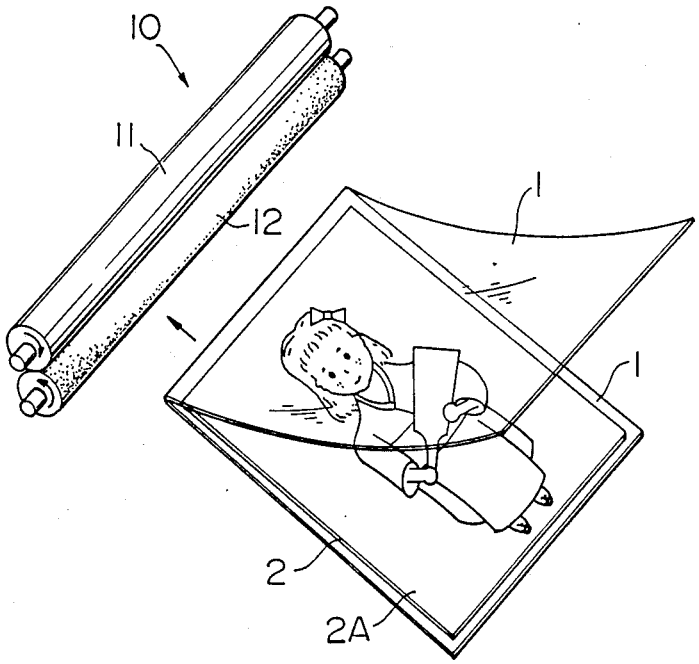
FIG. 1 is a perspective view showing a recording medium to be passed through a heat-fixing unit.

Referring to FIG. 1, there is shown a heat-fixing unit 10 for use in putting a heat-fixing method according to the invention into effect. The heat-fixing unit 10 is designed to heat-fix an image on a photo and pressure sensitive recording medium 2 coated with a heat-softening layer.

In the heat-fixing method according to the invention, a polyethylene terephthalate sheet (hereinafter referred to as "PET sheet") 1 is employed which is folded double into two sections. The recording medium 2 is sandwiched between the two sections of the folded PET sheet 1, and is passed through the heat-fixing unit 10.

Figure 3:
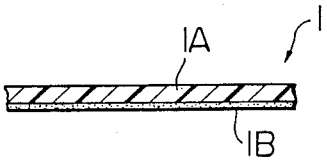
FIG. 3 is a fragmentary enlarged cross-sectional view of the sheet coated with the release-agent layer.

As shown in FIG. 3 in an enlarged cross-section, the PET sheet 1 is composed of a PET sheet substrate 1A whose one side has a predetermined smoothness. The one side of the PET sheet substrate 1A is subjected to a release processing. By the release processing, the one side of the PET sheet substrate 1A is coated, as a release agent, with a resin which is poor in wettability and large in an angle of contact. The resin includes silicone, fluoric resin, paraffinic wax, a mixture of silicone and acrylic resin, or the like. In this manner, a release-agent layer 1B is formed or coated on the one side of the PET sheet 1.

The PET sheet 1 is folded double into two sections such that release-agent layer sections 1B on the respective two sections of the folded PET sheet 1 are faced each other. The recording medium 2 is sandwiched between the two sections of the folded PET sheet 1 so that the recording medium 2 has a recording side 2A fully covered with the PET sheet 1. That is, the recording medium 2 is sandwiched between the two sections of the folded PET sheet 1 in such a manner that the recording side 2A of the recording medium 2 is faced to and abutted against the release-agent layer section 1B on one of the two sections of the folded PET sheet 1.

Figure 2A:
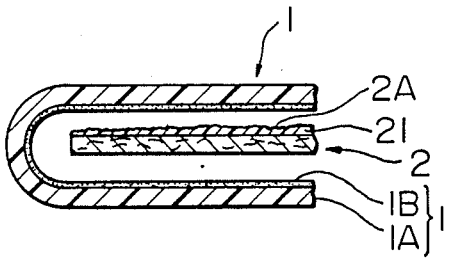
FIG. 2A is a fragmentary enlarged cross-sectional view of the recording medium sandwiched between two sections of a double-folded sheet whose one side is coated with a release-agent layer.

The recording medium 2 sandwiched between the two sections of the folded PET sheet 1 is illustrated in FIG. 2A in an enlarged cross-section. A heat softening layer 21 coated on one side of the recording medium 2 has a surface serving as the recording side 2A which is so intensive in irregularity that the recording side 2A has no gloss.

The heat-fixing unit 10 is a so-called heat-roller fixing unit comprising a pair of heat roller 11 and backup roller 12 which are so arranged as to have their respective axes extending parallel to each other in a vertical plane.

The heat roller 11 is of type wherein a heat source such as a halogen lamp or the like is incorporated in a cylindrical metallic roller such that the surface of the roller is heated to a predetermined temperature by heat from the heat source.

The backup roller 12 has a peripheral surface formed of elastic material having heat resistance such as silicone rubber or the like. The backup roller 12 is so arranged as to be urged against the heat roller 11 with a predetermined pressure by presurizing means, not shown.

Although not shown, either one of the heat roller 11 and the backup roller 12 is rotatively driven by drive means, and the other roller not rotatively driven is rotatable freely. Both the rollers 11 and 12 are in pressure contact with each other such that rotative driving of one of the rollers 11 and 12 causes both the rollers to be rotated together. A subject of fixing or the recording medium 2 is clamped between the pair of rollers 11 and 12 and is pressurized by the same. Meanwhile, the recording medium 2 is heated by heat from the heat roller 11, and is fed forwardly at a predetermined speed by rotation of both the rollers 11 and 12.

The heat-fixing unit 10 constructed as above is regulated in such a manner that the heat roller 11 is brought to about 140° C. The recording medium 2 sandwiched between the two sections of the folded PET sheet 1 is caused to pass through the nip between the heat roller 11 and the backup roller 12, with the fold of the PET sheet 1 serving as a leading edge, while being heated and pressurized. In this connection, since both the front and back sides of the recording medium 2 are faced respectively to the release-agent layer sections 1B on the respective two sections of the folded PET sheet 1, the recording side 2A of the recording medium 2 may face upwardly or downwardly. From the viewpoint of the heat efficiency, however, it is preferable that the recording side 2A of the recording medium 2 is faced to the heat roller 11.

Figure 2B:
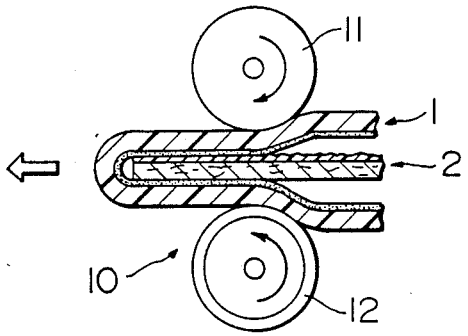
FIG. 2B is a fragmentary enlarged cross-sectional view of the recording medium as well as the sheet being passed through the heat-fixing unit.

FIG. 2b shows, in an enlarged cross-section, the recording medium 2 as well as the PET sheet 1 which are being caused to pass through the heat-fixing unit 10. As will be seen from FIG. 2B, the recording medium 2 is sandwiched, from both the front and back sides, between the two sections of the folded PET sheet 1 high in smoothness. The heat softening layer 21 on the recording medium 2 is softened and melted by heat from the heat roller 11. Thus, the surface of the heat softening layer 21 or the recording side 2A is flattened along the PET sheet 1 by the pressure between the heat roller 11 and the backup roller 12. The heat from the heat roller 11 is transmitted to the recording side 2A through the release-agent layer 1B to heat the heat softening layer 21, thereby softening and melting the same. However, the melted heat softening layer 21 is prevented from adhering to the release-agent layer 1B because of the above-mentioned characteristic of the release-agent layer 1B.

Figure 2C:
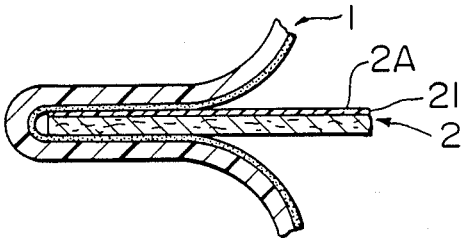
FIG. 2C is a fragmentary enlarged cross-sectional view of the sheet coated with the release-agent layer, which is being peeled off the recording medium after having been fixed.

After having passed through the heat-fixing unit 10, the PET sheet 1 is peeled off the recording medium 2 as shown in FIG. 2C. Thus, there is obtained the recording side 2A which is smooth correspondingly to the smoothness of the release-agent layer 1B. Since the heat softening layer 21 is prevented from adhering to the release-agent layer 1B on the PET sheet 1, the peeling-off between the release-agent layer 1B and the recording side 2A or the heat softening layer 21 on the recording medium 2 can easily be carried out.

By the above heat-fixing treatment, the gloss of the recording side 2A of the recording medium 2, which is of the order of 10, can be brought to a value of the order of 80 to 90. In this manner, the smoothness of the recording side 2A is raised so that the recording quality is enhanced.

The embodiment has been described as using the PET sheet 1 which is high in surface smoothness in order to give a gloss to the recording side 2A. If, however, a PET sheet is employed whose one side is roughened and is coated with the release-agent layer 1B, the recording side 2A of the recording medium 2 can be formed into a patted or silky surface. Further, a PET sheet can also be utilized whose one side has any desired irregular pattern, to create a corresponding irregular pattern onto the recording side 2A.

Moreover, although the embodiment has been described as utilizing the PET as the sheet substrate, it is needless to say that a resin film such as polyethylene, polypropylene, polyvinyl chloride, polyvinylidene chloride, polyimide or the like may be used as the sheet substrate. Further, it is also possible to employ a usual released sheet whose substrate is formed of paper.

According to the heat-fixing method of the invention, the surface smoothness of the recording medium can be enhanced to give a gloss thereto, making it possible to obtain the recording medium high in recording quality. Moreover, by varying the condition of the release-agent coated side of the recording medium, various surface conditions can be created on the recording side.

What is claimed is:

1. A heat-fixing method comprising the steps of:
providing a recording medium having an unfixed image upon a recording side thereof;
superimposing a sheet whose one side is coated with a release-agent layer upon at least said recording side of said recording medium such that the coated release-agent layer is faced to the recording side;
heating the recording medium through the sheet by heating means; and,
subsequently, peeling the sheet off the recording medium.

2. The heat-fixing method according to claim 1, wherein said heating means comprises a heat roller.

3. The heat-fixing method according to claim 1, wherein said sheet is a polyethylene terephthalate sheet.

4. The heat-fixing method according to claim 1, wherein said sheet is a polyethylene sheet.

5. The heat-fixing method according to claim 1, wherein said sheet is a polypropylene sheet.

6. The heat-fixing method according to claim 1, wherein said sheet is a polyvinyl chloride sheet.

7. The heat-fixing method according to claim 1, wherein said sheet is a polyvinylidene chloride sheet.

8. The heat-fixing method according to claim 1, wherein said sheet is a polyimide sheet.

9. The heat-fixing method according to claim 1, wherein said sheet is a paper sheet.

10. The heat-fixing method according to claim 1, wherein said release-agent layer is formed of silicone.

11. The heat-fixing method according to claim 1, wherein said release-agent layer is formed of fluoric resin.

12. The heat-fixing method according to claim 1, wherein said release-agent layer is formed of paraffinic wax.

13. The heat-fixing method according to claim 1, wherein said release-agent layer is formed of a mixture of silicone and acrylic resin.

14. A heat-fixing method comprising the steps of:
providing a sheet having one side coated with a release-agent;
folding the sheet double into two sections such that said coated release-agent layer on the respective two sections of the folded sheet face each other;
sandwiching a recording medium carrying thereon an unfixed image between the two sections of the folded sheet;
heating the recording medium through the folded sheet by heating means; and,
subsequently, peeling the sheet off the recording medium.

15. The heat-fixing method according to claim 14, wherein said heating means comprises a heat roller.

16. The heat-fixing method according to claim 14, wherein said sheet is a polyethylene terephthalate sheet.

17. The heat-fixing method according to claim 14, wherein said sheet is a polyethylene sheet.

18. The heat-fixing method according to claim 14, wherein said sheet is a polypropylene sheet.

19. The heat-fixing method according to claim 14, wherein said sheet is a polyvinyl chloride sheet.

20. The heat-fixing method according to claim 14, wherein said sheet is a polyvinylidene chloride sheet.

21. The heat-fixing method according to claim 14, wherein said sheet is a polyimide sheet.

22. The heat-fixing method according to claim 14, wherein said sheet is a paper sheet.

23. The heat-fixing method according to claim 14, wherein said release-agent layer is formed of silicone.

24. The heat-fixing method according to claim 14, wherein said release-agent layer is formed of fluoric resin.

25. The heat-fixing method according to claim 14, wherein said release-agent layer is formed of paraffinic wax.

26. The heat-fixing method according to claim 14, wherein said release-agent layer is formed of a mixture of silicone and acrylic resin.

* * * * *